US005842907A

United States Patent [19]

Niimura et al.

[11] Patent Number: 5,842,907

[45] Date of Patent: Dec. 1, 1998

[54] RADIO-CONTROLLED TOY MISSILE LAUNCHER

[75] Inventors: Koji Niimura; Munetoshi Miyasaka, both of Tokyo, Japan

[73] Assignee: Nikko Co., Ltd., Tokyo, Japan

[21] Appl. No.: 652,352

[22] Filed: May 23, 1996

[30] Foreign Application Priority Data

May 23, 1995 [JP] Japan ..... 7-124076

[51] Int. Cl.[6] ..... A63H 17/39; A63F 17/00; F41F 1/00

[52] U.S. Cl. ..... 446/435; 446/456; 124/26; 124/29; 124/37

[58] Field of Search ..... 446/435, 456; 124/16, 26, 27, 29, 37

[56] References Cited

U.S. PATENT DOCUMENTS

| | | | |
|---|---|---|---|
| 2,735,221 | 2/1956 | Fields | 124/29 |
| 2,964,032 | 12/1960 | Noble | 124/26 |
| 3,339,536 | 9/1967 | Glass et al. | 124/29 |
| 3,392,484 | 7/1968 | Ryan et al. | 446/435 |
| 3,807,379 | 4/1974 | Vodinh | 124/26 |
| 4,237,851 | 12/1980 | Haller | 124/16 |
| 4,333,261 | 6/1982 | Jones et al. | 46/257 |
| 4,399,803 | 8/1983 | Bertini | 124/1 |
| 4,721,091 | 1/1988 | Ridley et al. | 124/26 |
| 5,213,089 | 5/1993 | DeLuca | 124/29 |
| 5,295,890 | 3/1994 | Myers . | |

FOREIGN PATENT DOCUMENTS

| | | | |
|---|---|---|---|
| 0 700 703 | 3/1996 | European Pat. Off. . | |
| 2 044 114 | 10/1980 | United Kingdom . | |
| 2210279 | 6/1989 | United Kingdom | 446/443 |

*Primary Examiner*—Robert A. Hafer
*Assistant Examiner*—Laura Fossum
*Attorney, Agent, or Firm*—Young & Thompson

[57] ABSTRACT

A radio-controlled toy missile launcher with missile launch mount having a first end mounted on a chassis and a second end movable upward and downward. The missile launch mount has at least one missile projector accommodating a missile. A supporting member is provided to mechanically connect the chassis to the missile launch mount for supporting the missile launch mount. The supporting member is capable of rising up and falling down the second end of the missile launch mount. A thrust applying unit is provided in the missile projector for applying the missile with a thrust enough to allow launching of the missile. A missile holding member is provided in the missile projector for holding the missile from being launched. A release member engages the missile holding member for moving the missile holding member to release the missile from holding by the missile holding member thereby to allow launching of the missile by the thrust force.

18 Claims, 4 Drawing Sheets

RADIO-CONTROLLED TOY MISSILE LAUNCHER

BACKGROUND OF THE INVENTION

The present invention relates to a radio-controlled toy missile launcher. Whereas various attractive radio-controlled toys that show unique travelling or unique performances have been proposed in the art to which the invention pertains, a radio-controlled toy missile launcher for launching one or more missiles has not yet been proposed.

SUMMARY OF THE INVENTION

It is an object of the present invention to provide a radio-controlled toy missile launcher for launching one or more missiles.

The above and other objects, features and advantages of the present invention will be apparent from the following descriptions.

The present invention provides a radio-controlled toy missile launcher comprising the following elements. A missile launch mount has a first end mounted on a chassis and a second end movable upward and downward. The missile launch mount has at least one missile projector accommodating a missile. A supporting member is provided to mechanically connect the chassis to the missile launch mount for supporting the missile launch mount. The supporting member is capable of raising and lowering the second end of the missile launch mount. A thrust applying unit is provided in the missile projector for applying the missile with a thrust enough to allow launching of the missile. A missile holding member is provided in the missile projector for preventing the missile from being launched. A holding release member is engaged with the missile holding member for moving the missile holding member to release the missile from holding by the missile holding member to allow launching of the missile by the thrust force.

It is available to further provide a driving force generation unit being provided on the chassis for generating a driving force, and a driving force transmission mechanism being mechanically connected to the driving unit and the supporting member as well as the holding release member for transmitting the driving force of the driving unit to selected one of the supporting member and the holding release member. If the driving force is transmitted to the supporting member, then the supporting member raises and lowers the second end of the missile launch mount. If the driving force is transmitted to the holding release member then the holding release member release the missile from holding by the missile holding member.

BRIEF DESCRIPTIONS OF THE DRAWINGS

A preferred embodiment according to the present invention will be described in detail with reference to the accompanying drawings.

DISCLOSURE OF THE INVENTION

Figure 1:
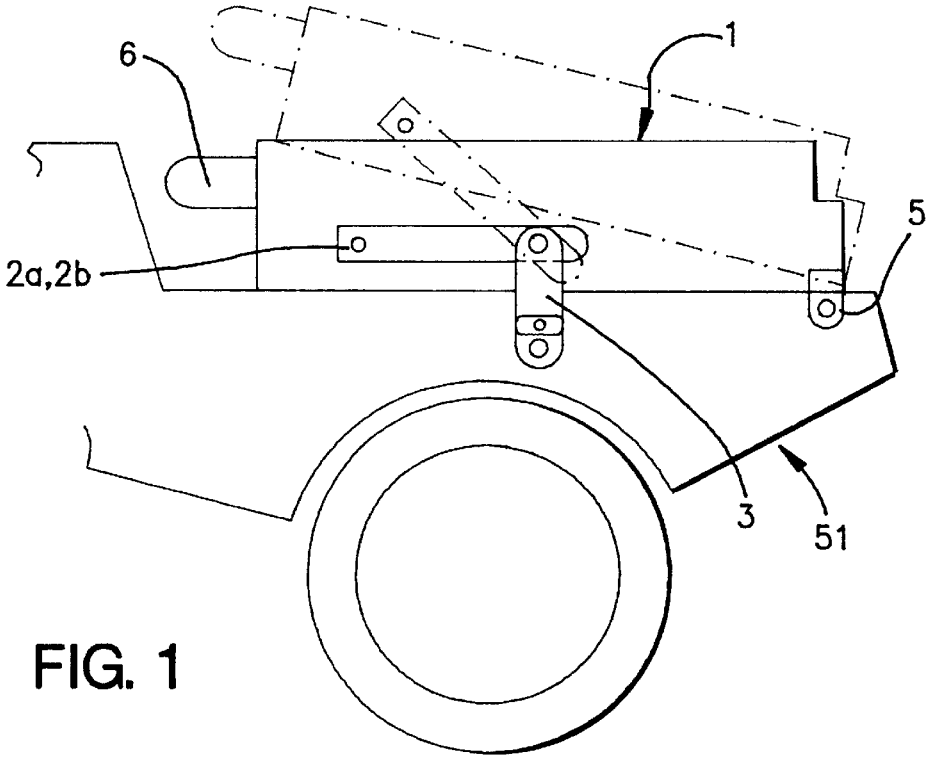
FIG. 1 is a schematic view illustrative of a radio-controlled missile launcher provided on a toy car in a preferred embodiment according to the present invention.

The present invention provides a radio-controlled toy missile launcher comprising the following elements. A missile launch mount has a first end mounted on a chassis and a second end movable upward and downward. The missile launch mount has at least one missile projector accommodating a missile. A supporting member is provided to mechanically connect the chassis to the missile launch mount for supporting the missile launch mount. The supporting member is capable of raising and lowering the second end of the missile launch mount. A thrust applying unit is provided in the missile projector for applying the missile with a thrust enough to allow launching of the missile. A missile holding member is provided in the missile projector for preventing the missile from being launched. A holding release member is engaged with the missile holding member for moving the holding member to allow launching of the missile by the thrust force.

It is possible to further provide a driving force generation unit being provided on the chassis for generating a driving force and a driving force transmission mechanism being mechanically connected to the driving unit and the supporting member as well as the holding release member for transmitting the driving force of the driving unit to selected one of the supporting member and the holding release member. If the driving force is transmitted to the supporting member, then the supporting member raises and lowers the second end of the missile launch mount. If the driving force transmitted to the holding release member then the holding release member releases the missile from holding by the missile holding member.

In the above case, it is preferable that the supporting member comprises a pair of first and second arms having first and second movable ends connected with the missile launch mount at right and left sides thereof and first and second fixed ends connected to the chassis. The first and second fixed ends are connected to the driving force transmission mechanism for receiving the driving force having been transmitted from the driving force generation unit so that the first and second arms show swing motions around the first and second fixed ends whereby the missile launch mount are raised and lowered.

Alternatively, it is also preferable that the supporting member comprises a pair of first and second arms having first and second movable ends connected to each other via a shaft and also connected with the missile launch mount at right and left sides thereof and first and second fixed ends connected to the chassis. At least one of the first and second fixed ends is connected to the driving force transmission mechanism for receiving the driving force having been transmitted from the driving force generation unit so that the first and second arms show swing motion around the first and second fixed ends whereby the missile launch mount are raised and lowered.

In the above case, it is more preferable that the first fixed end of the first arm is connected to the driving force transmission mechanism. The first arm comprises first and second portions. The first portion has one end being connected via the shaft to the second arm and an opposite end being connected via the driving force transmission mechanism to the driving force generation unit. The second portion has one end being mechanically connected to the chassis and an opposite end being pivotally connected with the one end of the first portion.

Alternatively, it is also more preferable that the second fixed end of the second arm is connected to the driving force transmission mechanism. The second arm comprises first and second portions. The first portion has one end being connected via the shaft to the second arm and an opposite end being connected via the driving force transmission mechanism to the driving force generation unit. The second portion has one end being mechanically connected to the chassis and an opposite end being pivotally connected with the one end of the first portion.

It is optionally available that the missile holding member comprises a ridged body having one end provided with a wedge portion and opposite end provided with a first projecting portion, and that the opposite end is pivotally fixed to the missile projector.

In those cases, it is optional that the holding release member comprises a ridged body provided with a second projecting portion which corresponds to the first projecting portion. If the ridged body receives the driving force, then the second projecting portion pushes the first projecting portion to move the missile holding member so that the missile is released from holding of the holding release member.

It is further possible that the driving force generation unit comprises a motor. If the motor rotates in a first direction, then the supporting member rises up and falls down the second end of the missile launch mount. If the motor rotates in a second direction, then the holding release member releases the missile from holding by the missile holding member.

In those cases, it is furthermore, possible that the driving force transmission mechanism comprises a transmission gear system including a one-way-clutch.

It is moreover possible to further provide a level detector on the chassis for detecting a level of the second end of the missile launch mount so that the missile is launched only when the detected level is above a predetermined level.

In those cases, it is still more possible to further provide a missile detector on the chassis for detecting the number of missile having been launched so that a predetermined number of the missiles have been launched before a missile launching operation is discontinued.

PREFERRED EMBODIMENT

A preferred embodiment according to the present invention will be described in detail with reference to the accompanying drawings, wherein there is provided a radio-controlled missile launcher placed on a toy car.

Figure 3:
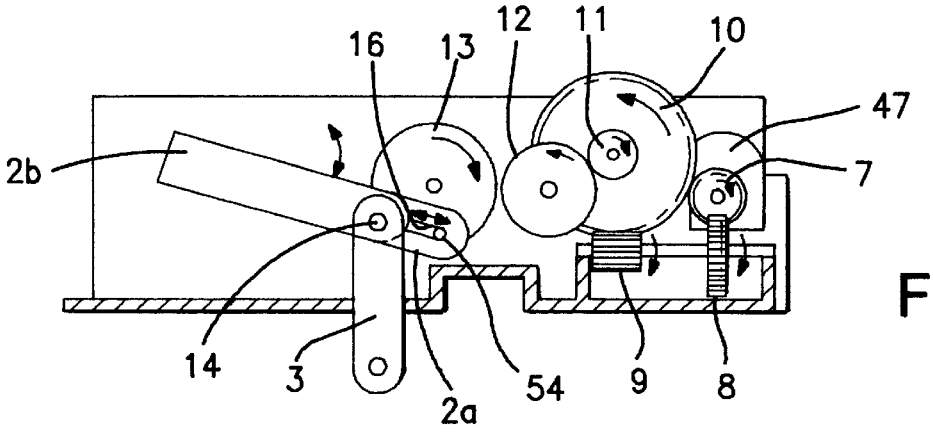
FIG. 3 is a left-side view illustrative of an internal mechanism of a radio-controlled missile launcher in a preferred embodiment according to the present invention.
Figure 4:
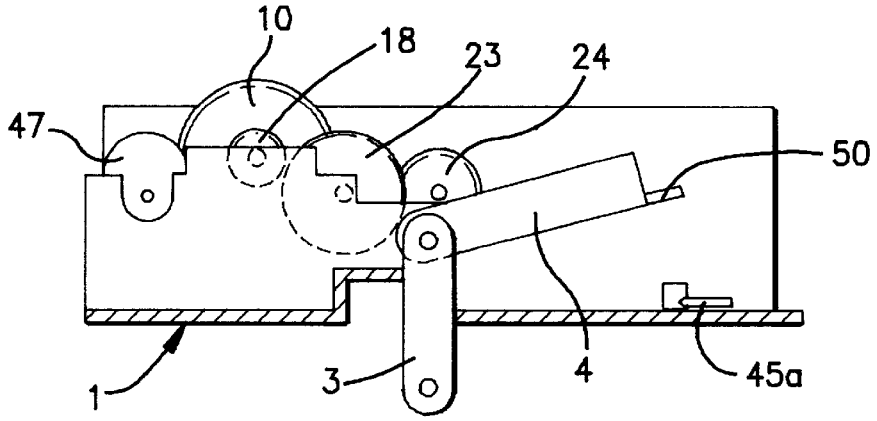
FIG. 4 is a right-side view illustrative of an internal mechanism of a radio-controlled missile launcher in a preferred embodiment according to the present invention.

A missile launcher 1 is mounted on a rear portion of a toy car 51 so as to allow up and down motions of the missile launcher 1. The missile launcher 1 is provided with arms 2*a* and 2*b* at the left side and an arm 4 at the right side as illustrated in FIGS. 3 and 4. The arms 2*a* and 2*b* and the arm 4 rotate to cause the missile launcher 1 to move up and down. The arms 2*a* and 2*b* are pivotally connected with each other at those one ends, with which an auxiliary attachment member 3 is further connected. The auxiliary attachment member 3 is mounted to a chassis of the toy car 51 to support the missile launcher 1. At a rear portion of the missile launcher 1, an auxiliary attachment member 5 is further provided. The missile launcher 1 is further provided with a projecting portion so that the auxiliary attachment member 5 is connected to this projecting portion, to thereby support the missile launcher 1. The missile launcher 1 carries a missile 6 which is placed in a launch-enabling state.

The following description will focus on internal mechanisms of the missile launcher 1 with references to FIGS. 2–5. The missile launcher 1 has a missile launching mechanism for launching a missile carried and a missile launcher raising and lowering mechanism for raising and lowering the missile launcher.

The missile launcher raising and lowering mechanism is provided at the left side of the missile launcher 1 with reference to a direction toward which a missile is launched. The missile launcher raising and lowering mechanism comprises the following elements. A motor 47 is provided for generating a rotation force and mechanically connected via a transmission gear system to the arms described above so as to transmit the rotation force to the arms. The transmission gear system comprises a first gear 7 engaged with a rotary shaft of the motor 47, a second gear 8 engaged with the first gear 7, a third gear 9 fixed on a rotary shaft of the second gear 8 to rotate in conjunction with the second gear 8, a fourth gear 10 engaged with the third gear 9, a fifth gear 11 fixed on a rotary shaft of the fourth gear 10 to rotate in conjunction with the fourth gear 10, a sixth gear 12 engaged with the fifth gear 11 and a seventh gear 13 engaged with the sixth gear 12. The seventh gear 13 has a rotary shaft which is mechanically connected to one end of the arm so that the arm rotates by a rotation of the rotary shaft of the seventh gear 13. Thus, the rotation generated by the motor 47 is transmitted via the above transmission gear system to the arm whereby the arm rotates. The rotation of the arm causes raising and lowering motions of the missile launcher 1.

Figure 6:
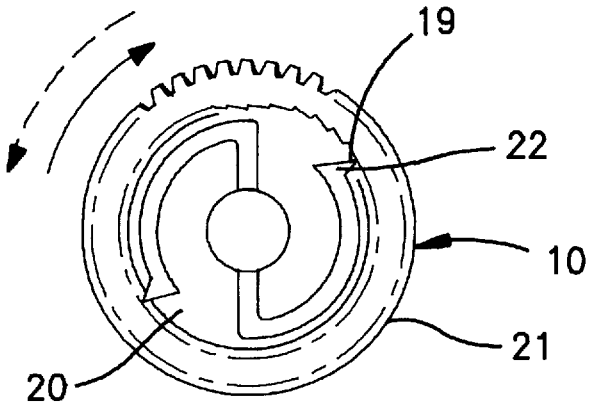
FIG. 6 is a plane view illustrative of a gear with a one-way clutch used in a internal mechanism of a radio-controlled missile launcher in a preferred embodiment according to the present invention.

The fourth gear 10 is provided with one-way clutch for switching the direction of the transmission of the driving force applied by the motor 47. If the fourth gear 10 rotates in a direction represented by arrow mark in FIG. 3, then the driving force is transmitted to the fifth and sixth gears 11 and 12. By contrast, if the fourth gear 10 rotates in the reverse direction, then the driving force is transmitted via a shaft 17 to a first gear 18 of the missile launching mechanism. A structure of the fourth gear 10 is illustrated in FIG. 6. The fourth gear 10 comprises a peripheral portion 21 and a center portion 20 surrounded by the peripheral portion 21. The peripheral portion 21 has gear teeth outwardly which are engaged with the third gear 9. The peripheral portion 21 and the center portion 20 rotate separately. The center portion 20 has two crews at diametrically opposite end portion thereof, wherein the crews extend outwardly. The peripheral portion 21 has a notched portion facing inwardly so that the crews of the center portion 20 are engaged with the notched portion of the peripheral portion 21. FIG. 6 illustrates a left side view of the fourth gear 10.

If the peripheral portion 21 rotates in a clockwise direction represented by a real line arrow mark, then the crews of the center portion 20 are engaged with the notched portion of the peripheral portion 21 whereby the rotation force of the peripheral portion 21 is transmitted to the center portion 20. Since the fifth gear 11 is fixed on the rotary shaft of the center portion 20, the rotation force is then transmitted to the fifth gear 11 whereby the fifth gear 11 rotates. The rotation of the fifth gear 11 is then transmitted via the sixth gear 12 and the seventh gear 13 to the arm 2 whereby the arm 2 rotates. The rotation of the arm 2 causes raising and lowering motions of the missile launcher 1.

By contrast, if the gear 10 rotates in the counter-clockwise direction represented by an arrow mark of broken line, then the crews of the center portion 20 are not engaged with the notched portion of the peripheral portion 21 whereby the rotation force of the peripheral portion 21 is not transmitted to the center portion 20. Therefore, the rotation force is not transmitted to the sixth and seventh gears 12 and 13. However, in the reverse side, the fourth gear 10 also has another notched portion which is inwardly formed as well as another center portion with other crews extending outwardly. The other crews of the center portion 20 are engaged with the other notched portion of the peripheral portion 21 whereby the rotation force of the peripheral portion 21 is, therefore, transmitted to the other center portion. This other center portion is mechanically connected via a rotary shaft to a first gear 18 of the missile launching mechanism. Then, the rotation force is transmitted via the rotary shaft to the first gear 18 of the launching mechanism.

In conclusion, if the fourth gear 10 rotates in the clockwise direction, then the rotation force is transmitted to the missile launcher raising and lowering mechanism whereby the missile launcher 1 is raised and lowered. If, however, the fourth gear 10 rotates in the counter-clockwise direction, then the rotation force is transmitted to the missile launching mechanism whereby the missile is launched. The rotation direction of the fourth gear 10 depends upon only the direction of rotation of the motor 47. This means that the direction of the rotation of the motor 47 determines whether the rotation force of the motor 47 is transmitted to the missile launching mechanism or the missile launcher raising and lowering mechanism.

The arms 2 and 4 are respectively provided in the left and right sides of the missile launcher 1 for raising and lowering the missile launcher 1. The arms 2 and 4 are mechanically connected at those one ends via a shaft 14 so that if the arm 2 rotates by the seventh gear 13, then the arm 4 also rotates.

The arm 2 comprises a first portion 2*a* and a second portion 2*b* both of which ar mechanically connected to the shaft 14 to rotate in conjunction with the arm 4. The first portion 2*a* of the arm 2 has one end which is mechanically connected to the shaft 14 and an opposite end which is provided with a projection which is mechanically connected to the auxiliary attachment member 3. The second portion 2*a* of the arm 2 has one end which is mechanically connected to the shaft 14 and an opposite end which is provided with a recessed portion 16. The first and second portions 2*a* and 2*b* of the arm 2 securely sandwich the shaft 14 by a spring force supplied by a spring member 52 pressing the first and second portions 2*a* and 2*b* on opposite sides. As a result, the first and second portions 2*a* and 2*b* of the arm 2 rotate in association with each other. If the missile launcher 1 raised from the toy car 50 is forceably pressed down, the spring member 52 extends so that all constitutional elements of the internal mechanism of the missile launcher 1 is accommodated with the car 50 with the exception of the first and second portions 2*a* and 2*b* of the arm 2 as well as the auxiliary attachment member 3. For these reasons, the transmission gear system and the motor are free from any damage or malfunction.

The recessed portion 16 of the second portion of the arm 2 is inserted with a projection 54 provided at an eccentric position of the seventh gear 13. As described above, the seventh gear 13 rotates by the rotation force via the transmission gear system from the motor 47 and then the projection 54 becomes positioned below the missile launcher 1. As a result, the projection 54 moves a right direction within the recessed portion 16 and further of the first portion 2*a* the end near the recessed portion 16 is lowered. Namely, the first and second portions 2*a* and 2*b* and the arm 4 rotate downward in a fulcrum of the shaft 14 whereby the missile launcher 1 is raised and prepared.

Thereafter, the seventh gear 13 rotates so that the projection 54 moves to raise the missile launcher 1. As a result, the projection 54 moves in the left direction within the recessed portion 16 by the rotation of the seventh gear 13 and then again moves in the right direction and further of the first arm 2*a* the end near the recessed portion 16 is raised up by the projection 54. Namely, the first and second portions 2*a* and 2*b* and the arm 4 rotate upwardly in the fulcrum of the shaft 14 whereby the missile launcher 1 is lowered to be accommodated within the toy car 50.

In conclusion, the rotation of the seventh gear 13 in the uniform direction caused the raising and lowering motions of the missile launcher 1.

Figure 2:
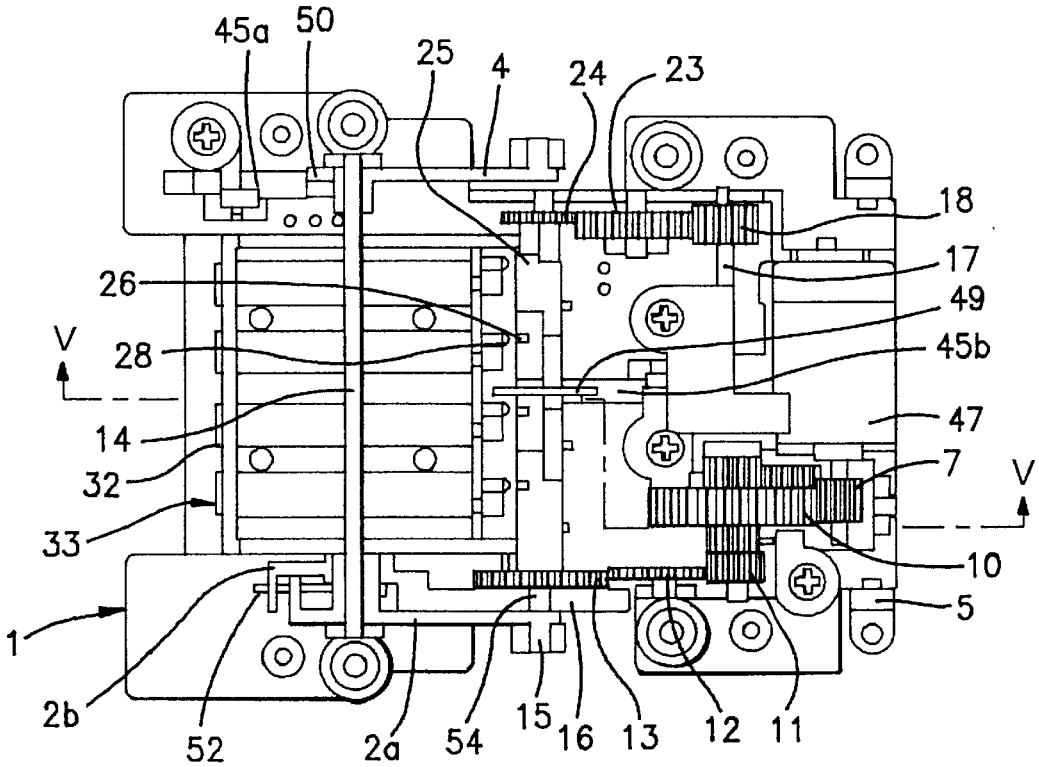
FIG. 2 is a plane view illustrative of an internal mechanism of a radio-controlled missile launcher in a preferred embodiment according to the present invention.
Figure 5:
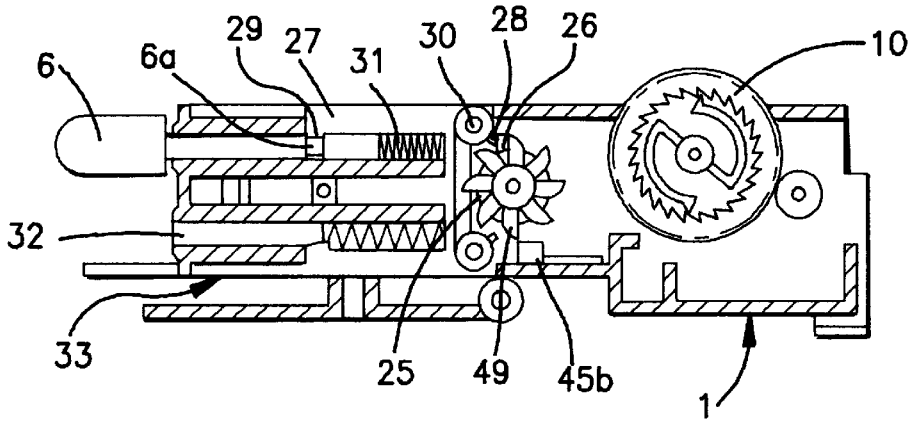
FIG. 5 is a cross sectional elevation view, along an V—V line in FIG. 2, illustrative of an internal mechanism of a radio-controlled missile launcher in a preferred embodiment according to the present invention.

The following description will focus on the missile launching mechanism with reference to FIGS. 2, 4 and 5. The missile launching mechanism is provided with first, second and third gears 18, 23, and 24. The first gear 18 is mechanically connected via the shaft 17 to the fourth gear 10 with the oneway clutch. The second gear 23 is engaged with the first gear 18. The third gear 24 is engaged with the second gear 23. The missile launching mechanism is further provided with a missile launching unit 33 which has eight missile projectors 32. In each of the missile projectors 32, a spring member 31 is provided for providing a spring force to the missile to cause a launch of the missile and a missile holder 27 for holding the missile forced by the spring member 31 to prevent the missile from launching. Behind the missile holder 27, a missile releaser 25 for releasing the missile from the holding with the holder 27 and launching the missile by the spring force of the spring member 31. The missile releaser 25 is capable of moving the missile holder 27 for the purpose of releasing the missile from the holding with the holder 27.

The missile holder 27 has a wedge portion 29 which hooks a groove 6*a* provided on one end of the missile 6 and a projecting portion 28 for raising the wedge portion 29 when pushed 29 when pushed up by the missile releaser 25. The missile holder 27 is pivotally mounted via an attachment 30 to the missile launching unit 33 in the vicinity of the projecting portion 28.

The missile releaser 25 is provided with a projecting portion 26 corresponding to the projecting portion 28 provided on the missile holder 27. When the missile releaser 25 rotates by a rotation force having transmitted via the third gear 24, then the projecting portion 26 pushes the projecting portion 28 provided on the missile holder 28 whereby the wedge portion 29 of the missile holder 27 is raised in a fulcrum of the attachment 30. As a result, the missile is released from the holding by the missile holder 27 and then launched from the missile projector 32 by the spring force applied by the spring member 31.

The launching timings of the individual missiles are determined by positions of the projecting portions 26 on the missile holders 25. If the projecting portions 26 are aligned linearly and horizontally, then all of the missiles 6 are launched at the same time. If, however, the projecting portions 26 are provided linearly but obliquely, then the missiles 6 are launched sequentially at a uniform time interval.

Figure 7:
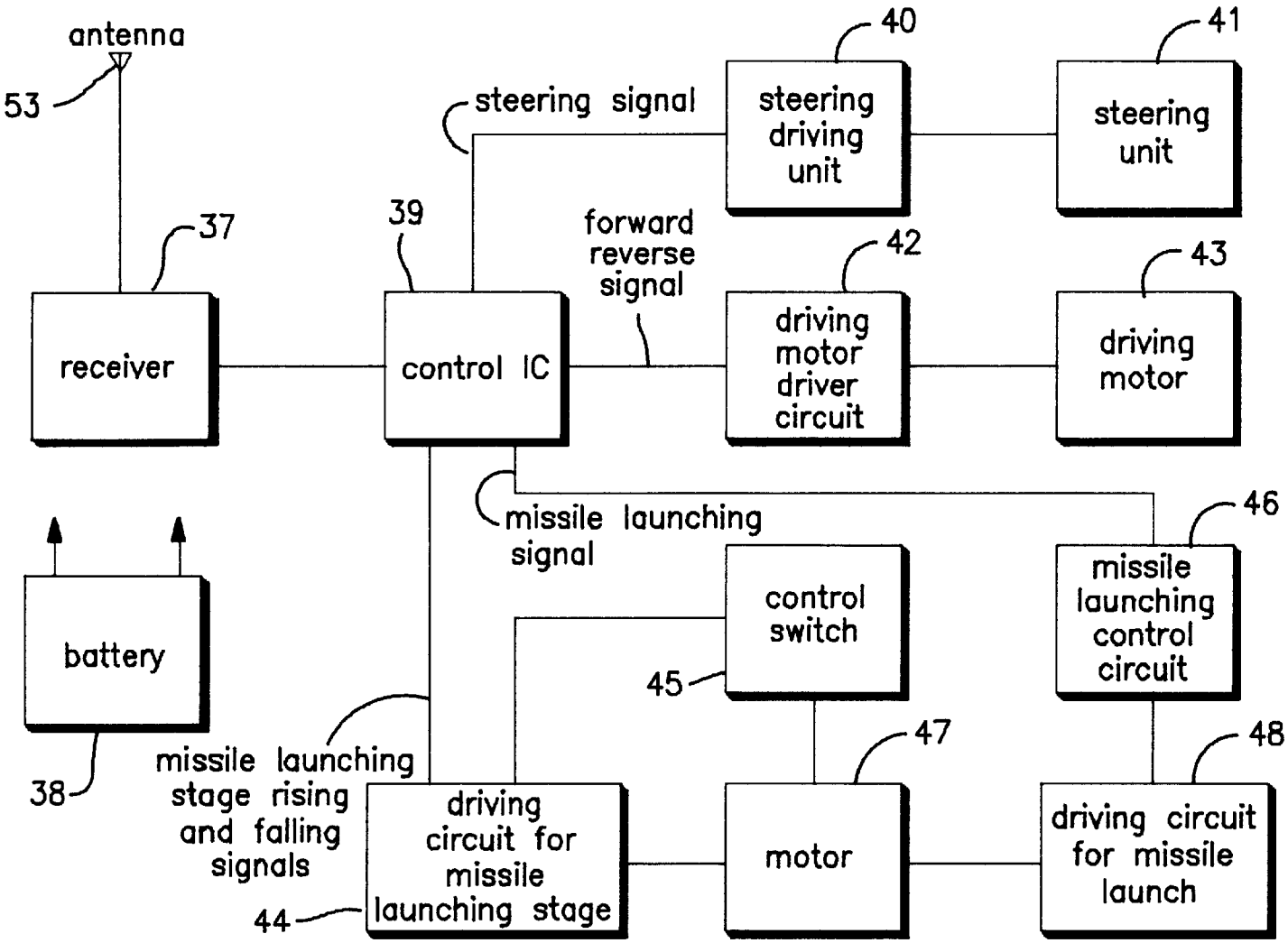
FIG. 7 is a block diagram illustrative of a control unit for controlling a radio-controlled missile launcher in a preferred embodiment according to the present invention.

The above described missile launcher raising and lowering mechanism and the missile launching mechanism are operated under the control of a control unit as follows. A configuration of the control unit is illustrated in FIG. 7. The control unit comprises the following elements. An antenna 53 is provided for receiving control signals having been transmitted from a transmitter. A receiver 37 is provided to be electrically connected to the antenna 53 for fetching the control signals from the antenna 53 and then demodulating the fetched control signals. A control IC 39 is provided to be electrically connected to the receiver 37 for fetching the demodulated control signals and then generating a steering signal, forward/reverse signals, a missile launching signal and missile launching stage raising and lowering signals. A steering driving circuit 40 is provided to be electrically connected to the control IC for fetching the steering signal from the control IC and also connected to a steering unit 41 for controlling the steering unit in accordance with the fetched steering signal. A driving motor driver circuit 42 is provided to be electrically connected to the control IC 39 for fetching the forward/reverse signals from the control IC 39 and also connected to a driving motor 43 for controlling the driving motor 43 in accordance with the fetched forward/reverse signals. A missile launcher driving circuit 44 is provided to be electrically connected to the control IC 39 for fetching the missile launcher raising and lowering signals from the control IC 39 and also connected to a missile launcher raising and lowering motor 47 for controlling the same. A missile launching control circuit 46 is provided to be electrically connected to the control IC 39 for fetching a missile launching signal from the control IC 39. The missile launching control circuit 46 comprises flip-flop circuits. A missile launching driving circuit 48 is electrically connected to the missile launching control circuit 46 for fetching the missile launching control signals from the missile launching control circuit 46 and also connected to the motor 47 for control operations of the motor 47 in accordance with the fetched missile control signals so that the motor 47 is driven only when there appears a requirement for launching the missile. A control switch is provided to be connected to the missile launcher driving circuit 44, the motor 47 and the missile launching control circuit 46. The above circuits, units and motors are operable by receiving power from a battery 38.

Figure 8:
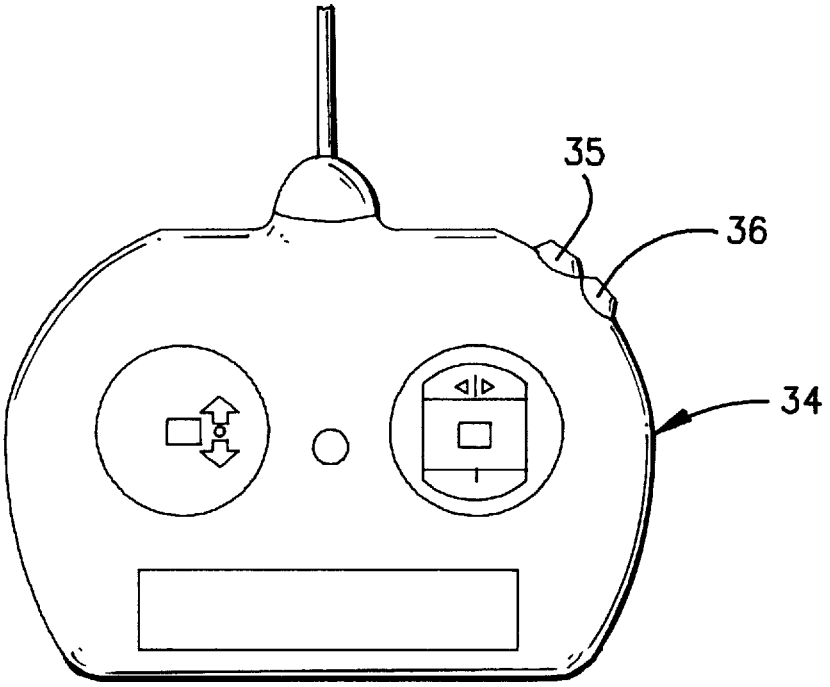
FIG. 8 is a front view of a transmitter used for transmitting radio-control signals to a radio-controlled missile launcher in a preferred embodiment according to the present invention.

A radio transmitter used for transmitting control signals to the above control unit is illustrated in FIG. 8. A radio transmitter 34 is provided at its center portion with a control lever for controlling movement of the toy car, for example, forward/reverse traveling and turning right and left. The radio transmitter 34 is further provided at its right top side portion with a missile launching switch 35 and a missile launcher raising and lowering switch 36.

When the missile launcher raising and lowering switch 36 of the radio transmitter 34 is turned ON, the radio transmitter 34 transmits the missile launcher raising and lowering signals to the control unit. The missile launcher raising and lowering signals is transmitted via the receiver 37 to the control IC 39. The control IC 39 feeds the missile launcher raising and lowering signals to the missile launcher driving circuit 44. The missile launcher driving circuit 44 drives the motor 47 placed on the missile launcher 1 so that the fourth gear 10 rotates in the clockwise direction represented by the arrow mark of real line FIG. 6. As described above, the rotation of the fourth gear 10 in the clockwise direction is transmitted to the seventh gear 13. Since the arm 2 comprising the first and second portions 2*a* and 2*b* is fixed to the seventh gear 13, the rotation is then transmitted to the arm 2 whereby the raising and lowering motions of the missile launcher 1 are caused.

When the missile launcher raising and lowering switch 36 of the radio transmitter 34 is turned OFF, the transmission of the missile launcher raising and lowering signals is discontinued whereby driving of the motor 47 by the missile launcher driving circuit 44 is also discontinued. As a result, the raising and lowering motions of the missile launcher 1 are then discontinued. The missile launcher 1 can be set at a desirable position by keeping the missile launcher raising and lowering switch 36 in the ON state until the missile launcher 1 reaches the desirable position. If the missile launcher raising and lowering switch 36 is kept in ON state, then the raising and lowering motions of the missile launcher 1 are also continued.

On the other hand, the missile launching control will be described. In order to launcher the missile, it is necessary that the missile projector 32 is placed above the toy car. A first switch 45*a* is provided in the vicinity of the arm 4 to detect position of the missile launcher 1. For example, as illustrated in FIGS. 3 and 4, the arm 4 is provided with a projecting portion 50 so that if the missile launcher 1 is accommodated in the toy car, then the projecting portion 50 pushes the switch 45*a*. When the projecting portion 50 of the arm 4 pushes the switch 45*a*, then the missile launcher control circuit 46 does not feed the missile launching signal to the missile launcher driving circuit 48. If, however, the missile launcher 1 is raised and positioned above the toy car, then the projecting portion 50 of the arm 4 is detached from the switch 45*a* whereby the missile launcher control circuit 46 feeds the missile launching signal to the missile launching driving circuit 48. As a result, the missile is launched from the projector.

In conclusion, when the projecting portion 50 of the arm 4 pushes the switch 45*a*, the control IC 39 feeds a missile launching inhibiting signal to missile launching control circuit 46 whereby the missile launching control circuit 46 does not feed the missile launching signal to the missile launcher driving circuit 48.

A second switch 45*b* is further provided in the vicinity of the missile releaser 25 for control timing of the launching of the missile 6. For example, as illustrated in FIGS. 3 and 5, the missile releaser 25 is provided with a timing gear 49 which is provided with teeth at a predetermined interval, wherein the teeth reaches the second switch 45*b*. The rotation of the missile releaser 25 causes a rotation of the timing gear 49 so that the teeth push the second switch 45*b* whereby the rotation of the motor is discontinued. As a result, the missiles are launched discontinuously.

It is possible to modify the positions and the number of the teeth of timing gear 49 to match the projecting portion 26 provided on the missile releaser 25 so that discontinuation of launching of the missiles can be controlled.

The missile launching operations will be described as follows. When the missile launching switch 35 provided on the radio transmitter 34 is pushed, then the missile launching signal is transmitted to the control unit and received by the antenna 53. The missile launching signal is then transmitted via the receiver 37 to the control IC 39. The control IC then feeds the missile launching signal to the missile launching control circuit 46. The missile launching control circuit 46 confirms that no missile launching inhibiting signal is generated via the first switch 45*a* which is detectable to the position of the missile launcher 1, before the missile launching control circuit 46 feeds the missile launching signal to the missile launcher driving circuit 48. If the missile launching inhibiting signal is generated via the first switch 45*a*, then the missile launching control circuit 46 does not feed the missile launching signal to the missile launcher driving circuit 48. Thereafter, if the missile launcher 1 is raised then the missile launcher driving circuit 48 receives the missile launching signal from the missile launching control circuit 46. The missile launching control circuit 48 drives the motor 47 so that the fourth gear 10 rotates in the counter-clockwise direction represented by the arrow mark of broken line as in FIG. 6. As a result, the missile releaser 25 rotates so that the missiles are released from the missile holder 27 and launched by the spring force of the spring member.

It is possible that if one missile is launched, the teeth of the timing gear 49 push the second switch 45*b* so that the rotation of the motor 47 is discontinued after one missile was launched. If the missile launching switch is pushed again, then other missile 6 is also launched.

Whereas in the above embodiment the first switch 45*a* is provided for detecting the position of the missile launcher, any other detectors are available for detecting the position of the missile launcher 1 such as optical sensors. In place of the timing gear 49 and the second switch 45*b*, encoder may be used to determine when the rotation of the motor should be discontinued on the bases of a relationship between the rotation speed of the missile releaser 25 and the position of the projecting portion 26 or by a sensor provided on the missile projector 32.

In place of the arm 2 and 4, a rack and a pinion are available in cooperation with the transmission gear system described above in order to raise and lower the missile launcher 1.

The above missile launching mechanism and the missile launcher raising and lowering mechanism are applicable to not only the toy car but also to any other toys such as ships and robots.

Whereas modifications of the present invention will be apparent to a person having ordinary skill in the art, to which the invention pertains, it is to be understood that embodiments as shown and described by way of illustrations are by no means intended to be considered in a limiting sense. Accordingly, it is to intended to cover by claims all modifications which fall within the spirit and scope of the present invention.

What is claimed is:

1. A toy missile launcher for launching a missile, comprising:

a chassis;

a unitary missile launch mount having a first end, a second end, and a missile projector for accommodating the missile;

an attachment member pivotally mounting the first end of said missile launch mount on said chassis to raise and to lower the second end of said missile launch mount;

a thrust-applying means in the missile projector for applying sufficient thrust to launch the missile;

a missile holder in the missile projector resisting the thrust of the thrust applying means to prevent launching of the missile;

a missile releaser engaging said missile holder to launch the missile selectively; and a bi-directional motor engaging a first one-way clutch and a second one-way clutch;

the first one-way clutch cooperating with said attachment member functioning to raise and to lower the second end of said missile launch mount when said motor is in a first direction;

the second one-way clutch cooperating with said missile releaser functioning to release the missile when said motor is in a second direction opposite said first direction.

2. A toy missile launcher according to claim 1, further comprising a detector on said chassis for detecting a position of the second end of said missile launch mount and for selectively transmitting an inhibiting signal to prevent launching of the missile.

3. A toy missile launcher according to claim 1, further comprising a control unit on said chassis for raising and for lowering said missile launch mount and for launching the missile by controlling a driving direction of said motor.

4. A toy missile-launcher comprising:

a chassis;

a missile launch mount having a first end mounted on said chassis and a second end movable upward and downward so that said missile launch mount pivots around said first end, said missile launch mount having at least one missile projector accommodating a missile;

a supporting means mechanically connecting said chassis to said missile launch mount for supporting said missile launch mount, said supporting means comprising a pair of first and second arms having first and second movable ends directly connected to said missile launch mount at right and left sides thereof respectively and first and second fixed ends connected through third and fourth fixed arms to said chassis, respectively;

a thrust-applying means in said missile projector for applying said missile with sufficient thrust to launch said missile;

a missile holding means in said missile projector for preventing said missile from being launched;

a release means engaging said missile holding means for moving said missile holding means by utilizing an external driving force so as to release said missile from being held by said missile holding means to allow launching said missile by said thrust;

a bi-directional motor on said chassis for generating said driving force;

a first transmission gear mechanism on said chassis mechanically connecting a clutch mechanism to said single motor for transmitting said driving force of said single motor to said clutch mechanism;

a second transmission gear mechanism on said chassis mechanically connecting said clutch mechanism to said supporting means for transmitting said driving force of said single motor to said supporting mean when said motor is in a first direction, whereby said supporting means raises and lowers said second end of said missile launch mount;

a third transmission gear mechanism on said chassis mechanically connecting said clutch mechanism to said release means for transmitting said driving force of said single motor to said release means, whereby said release means when said motor is in a second direction, opposite said first direction moves said missile holding means to release said missile from being held by said missile holding means, wherein said first and second movable ends move to keep positions, on a horizontal and longitudinal coordinate, between said first and second ends of said missile launch mount, said first and second fixed ends of said first and second arms being closer to said first end of said missile launch mount than said first and second movable ends of said first and second arms, said first and second fixed ends of said first and second arms being connected via a rotary shaft to said second transmission gear mechanism for receiving said driving force from said single motor so that said first and second arms pivot around said first and second fixed ends thereof, whereby said missile launch mount also pivots around said first end, provided that said first and second movable ends of said first and second arms move to keep positions, on said horizontal and longitudinal coordinate, farther from said first end of said missile launch mount than said first and second fixed ends.

5. The toy missile launcher as claimed in claim 4, wherein said launcher further comprising a control unit on said chassis and electrically connected to said single motor for receiving first and second control signals and controlling said single motor to drive in said first direction upon receipt of said first control signal and to drive said single motor in said second direction upon receipt of said second control signal, said clutch mechanism comprising a pair of first and second one-way clutches, said first one-way clutch engaging said second transmission gear mechanism for transmitting said driving force to said second transmission gear mechanism only when said single motor rotates in said first direction, said second one-way clutch engaging said third transmission gear mechanism for transmitting said driving force to said third transmission gear mechanism only when said single motor rotates in said second direction, so that if said single motor rotates in said first direction, then said clutch mechanism transmits said driving force through said second transmission gear mechanism to said supporting means for raising and lowering said second end of said missile launch mount, and if said single motor rotates in said second direction, then said clutch mechanism transmits said driving force through said third transmission gear mechanism to said release means for launching said missile.

6. The toy missile launcher as claimed in claim 5, further comprising a level detector on said chassis for detecting a level of said second end of said missile launch mount, said level detector supplying a motor drive inhibiting signal to said control unit so that said control unit inhibits said single motor from driving in said second direction even upon receipt of said second control signal.

7. The toy missile launcher as claimed in claim 4, wherein said missile holding means comprises a ridged body having one end provided with a wedge portion and an opposite end provided with a first projecting portion, said opposite end being pivotally mounted to said missile projector.

8. The toy missile launcher as claimed in claim 7, wherein said release means comprises a ridged body provided with a second projecting portion corresponding to said first projecting portion, so that when said ridged body receives said driving force, then said second projecting portions pushes said first projecting portion to move said missile holding means releasing said missile being held by said holding means.

9. The toy missile launcher as claimed in claim 4, further comprising a missile detector on said chassis for detecting a number of missiles that have been launched to launch a predetermined number of said missiles continuously before a missile launching operation is automatically discontinued.

10. A toy missile launcher comprising:

a chassis;

a missile launch mount having a first end mounted on said chassis and a second end movable upward and downward, said missile launch mount having at least one missile projector accommodating a missile;

a supporting means mechanically connecting said chassis to said missile launch mount for supporting said missile launch mount and for raising and lowering said second end of said missile launch mount by utilizing an external driving force;

a thrust-applying means in said missile projector for applying said missile with sufficient thrust to launch said missile;

a missile holding means in said missile projector for preventing said missile from being launched;

a release means engaging said missile holding means for moving said missile holding means by utilizing said external driving force so as to release said missile from being held by said missile holding means to allow launching said missile by said thrust;

a single bi-directional motor on said chassis for generating said driving force;

a control unit on said chassis electrically connected to said single motor for receiving first and second control signals and controlling said single motor to drive in a first direction upon receipt of said first control signal and to drive said single motor in a second direction upon receipt of said second control signal;

a first transmission gear mechanism on said chassis mechanically connecting a clutch mechanism to said single motor for transmitting said driving force of said single motor to said clutch mechanism;

a second transmission gear mechanism on said chassis mechanically connecting said clutch mechanism to said supporting means for transmitting said driving force of said single motor to said supporting means whereby said supporting means for raising and lowering said second end of said missile launch mount;

a third transmission gear mechanism on said chassis mechanically connecting said clutch mechanism to said release means for transmitting said driving force of said single motor to said release means, whereby said release means moves said missile holding means to release said missile from being held by said missile holding means, wherein said clutch mechanism comprises a pair of first and second one-way clutches, said first one-way clutch engaging said second transmission gear mechanism for transmitting said driving force to said second transmission gear mechanism only when said single motor rotates in a first direction, said second one-way clutch engaging said third transmission gear mechanism for transmitting said driving force to said third transmission gear mechanism only when said single motor rotates in a second direction, so that if said single motor rotates in said first direction, then said clutch mechanism transmits said driving force through said second transmission gear mechanism to said supporting means for raising and lowering said second end of said missile launch mount, and if said single motor rotates in said second direction, then said clutch mechanism transmits said driving force through said third transmission gear mechanism to said release means for releasing and launching said missile.

11. The toy missile launcher as claimed in claim 10, wherein said supporting means comprises a pair of first and second arms each having first and second movable ends connected with said missile launch mount at right and left sides thereof respectively and first and second fixed ends connected to said chassis, said first and second fixed ends being connected to said second transmission gear mechanism for receiving said driving force from said single motor so that said first and second arms pivot around said first and second fixed ends respectively whereby said missile launch mount is raised and lowered.

12. The toy missile launcher as claimed in claim 10, wherein said supporting means comprises a pair of first and second arms having first and second movable ends connected to each other via a shaft and also connected to said missile launch mount at right and left sides thereof as well as having first and second fixed ends connected to said chassis, at least one of said first and second fixed ends being connected to said second transmission gear mechanism for receiving said driving force from said single motor so that said first and second arms pivot around said first and second fixed ends whereby said missile launch mount is one of raised and lowered.

13. The toy missile launcher as claimed in claim 12, wherein said first fixed end of said first arm is connected to said second transmission gear mechanism, said first arm comprising first and second portions, said first portion having one end connected via said shaft to said second arm and an opposite end connected via said second transmission gear mechanism to said single motor, said second portion having one end mechanically connected to said chassis and an opposite end pivotally connected to said one end of said first portion.

14. The toy missile launcher as claimed in claim 12, wherein said second fixed end of said second arm is connected to said second transmission gear mechanism, said second arm comprising first and second portions, said first portion having one end connected via said shaft to said second arm and an opposite end connected via said second transmission gear mechanism to said single motor, said second portion having one end mechanically connected to said chassis and an opposite end pivotally connected to said one end of said first portion.

15. The toy missile launcher as claimed in claim 10, wherein said missile holding means comprises a ridged body having one end with a wedge portion and an opposite end with a first projecting portion, said opposite end of said holding means pivotally mounted to said missile projector.

16. The toy missile launcher as claimed in claim 15, wherein said release means comprises a ridged body with a second projecting portion corresponding to said first projecting portion, so that when said ridged body receives said driving force, then said second projecting portion pushes said first projecting portion to move said missile holding means releasing said missile being held by said holding means.

17. The toy missile launcher as claimed in claim 10, further comprising a level detector on said chassis for detecting a level of said second end of said missile launch mount, said level detector supplying a motor drive inhibiting signal to said control unit so that said control unit inhibits said single motor from driving in said second direction even upon receipt of said second control signal.

18. The toy missile launcher as claimed in claim 10, further comprising a missile detector on said chassis for detecting a number of missiles that have been launched to launch a predetermined number of said missiles continuously before a missile launching operation is automatically discontinued.

* * * * *